United States Patent [19]

Satterfield et al.

[11] Patent Number: 4,968,238

[45] Date of Patent: Nov. 6, 1990

[54] APPARATUS FOR MAKING A NON-WOVEN SHEET

[75] Inventors: Richard A. Satterfield, Richmond, Va.; David M. Taylor, Llanfairfechan, United Kingdom

[73] Assignee: E. I. Du Pont de Nemours and Company, Wilmington, Del.

[21] Appl. No.: 411,025

[22] Filed: Sep. 22, 1989

[51] Int. Cl.[5] ..... B29C 47/92; B29C 71/04

[52] U.S. Cl. ..... 425/135; 425/174.8 E; 425/224; 264/22; 264/40.1; 264/205

[58] Field of Search ..... 264/40.1, 22, 205; 425/135, 136, 174.8 E, 83.1, 223, 224

[56] References Cited

U.S. PATENT DOCUMENTS

| | | | |
|---|---|---|---|
| 3,169,899 | 2/1965 | Steuber | 161/72 |
| 3,340,429 | 9/1967 | Owens | 317/3 |
| 3,387,326 | 6/1968 | Hollberg et al. | 18/8 |
| 3,489,895 | 1/1970 | Hollberg | 250/49.5 |
| 3,578,739 | 5/1971 | George | 425/174.8 E |
| 3,655,307 | 4/1972 | Hawkins | 425/174.8 E |
| 3,860,369 | 1/1975 | Brethauer et al. | 425/3 |
| 4,208,366 | 6/1980 | Kinney | 425/174.8 E |
| 4,537,733 | 8/1985 | Farago | 264/9 |
| 4,666,395 | 5/1987 | Shah | 425/377 |

OTHER PUBLICATIONS

Davies, J. Scientific Instruments, 1967, vol. 44, pp. 521-524, "The Examination of the Electrical Properties of Insulators by Surface Charge Measurement".

*Primary Examiner*—Jay H. Woo
*Assistant Examiner*—Khanh P. Nguyen

[57] ABSTRACT

A device to detect the loss of a continuous spun web of plexifilament fibers exiting a forwarding apparatus depends on the manner in which the filaments oscillate in a cross machine direction prior to depositing onto a collecting surface. The loss of these fibers, due to hang up in the filament forwarding device, can cause multiple position spinning machine loss due to the knock down of nearby spinning positions or wrap the sheet on forwarding rolls. The hang up in the forwarding device is referred to as a blow-up. This invention detects the instant a blow-up occurs through the loss of electrostatic charge due to the absence of the oscillating swath at the sensor. When the instant charge is lost at the sensor, a signal indicates a blow-up has occurred.

2 Claims, 4 Drawing Sheets

APPARATUS FOR MAKING A NON-WOVEN SHEET

BACKGROUND OF THE INVENTION

This invention relates to a process and apparatus for making a non-woven sheet by flash spinning a plexifilamentary strand, spreading the strand to form a web and oscillating the web and charging the web, and, more particularly, it relates to a process and apparatus for detecting loss of oscillation of the web and signaling said loss to indicate the need for corrective action.

A single position apparatus for use in making nonwoven fibrous sheets of organic synthetic polymers is disclosed by Brethauer et al. in U.S. Pat. No. 3,860,369. Farago, in U.S. Pat. No. 4,537,733, discloses a multiposition apparatus of the type disclosed in Brethauer et al. to produce wide non-woven sheets at greater throughputs. However, as throughputs increase, the potential also increases for blow-ups to occur which in turn cause multiposition spinning machine loss due to knock-down of adjacent positions. More particularly, a blow-up is an occurrence in which flash spun fibers hang in the fibers forwarding device and prevents the fibers from being transported in a gas stream to a woven metal lay down belt. When a blow-up occurs, the position is likely to drop a large bundle of accumulated fibers which knock down nearby spinning positions or become entangled in transporting rolls resulting in a total spinning machine shutdown. Also, blow-ups can be caused by the loss of electrostatic charge on the spun fibers. The loss of electrostatic charge allows the fibers to fly freely above the metal lay down belt due to the loss of electrostatic pinning. The free floating fibers then become entangled in nearby spinning positions generating additional blow-ups.

Continuous visual observation by personnel positioned at strategic locations is required to detect a position blow-up. Often a blown position can go undetected for several seconds which can then cause large clumps of fibers being deposited onto the lay down belt or to flare out and knock down nearby positions and, since the detection of a blow-up requires human intervention, mistakes are often made in shutting down incorrect positions. Other methods of detecting a blow-up can be through video camera observation or light beam disruption, each of which are susceptible to dirt or polymer dust buildup making the device inoperable.

Another method could be the use of an electrostatic detector known as a field mill. A field mill is a device in which an electrostatic charge sensing area is located behind a rotating metal blade similar to a fan blade. The rotation of the grounded blade alternately forces charge to build up and collapse on the sensing area. This rotation of the blade produces an AC voltage on the sensing area proportional to the charge in front of the sensing area. Because electrostatic charge on plastic forwarding devices can build up to many times the charge on the spun filaments, the field mill is limited in detection of only the fiber electrostatic charge. This device can have large errors introduced due to electrostatically charged surfaces nearby and must be gas purged to prevent fiber and polymer entanglement on the rotating blade and sensor.

SUMMARY OF THE INVENTION

The present invention overcomes the above-stated problems by mounting a charge sensor directly to the apparatus for forwarding the charged fibrous web and is totally enclosed eliminating build up of contaminants. The oscillation of the charged web in the cross direction of the forwarding device induces electrostatic charge onto the surface of a stationary sensor that has no moving parts. The swath oscillation serves as a means of creating a build up and collapse of electrostatic charge on the sensor surface. This unique feature eliminates error from nearby electrostatically charged surfaces and only detects elecrostatic charge from surfaces that move in an oscillating fashion across the fixed charge detecting sensor.

More particularly, the apparatus for forming the fibrous web includes a means for flash spinning a polymer solution to form a plexifilamentary strand, means for spreading the strand to form the fibrous web and oscillate it at a frequency in a path in a generally vertical plane toward a collecting surface and means for charging the web. An aerodynamic shield having front and rear members is disposed on each side of the vertical plane and a charge detector is fixed within the front member of the shield at a position within the oscillating path of the web. The charge detector has an output terminal connected to a signaling means. The charge detector provides a signal proportional to the oscillating frequency of the oscillating charged web and the signaling means signals the absence of the signal to indicate loss of oscillation of the web.

The charge detector uses the natural frequency of the oscillating swath as an electrostatic field chopper rather than the conventional field mill standard instrument. This feature eliminates false charge measurements being induced from charged surfaces such as non-conducting diffusers which build up high levels of charge due to their proximity to the charged swath. Also, because the detector has no moving parts, the need to purge with forced gas to keep surfaces clean is eliminated. Incorporated in the sensor is a single transistor preamplifier to provide a low impedance output and eliminate signal attenuation due to cable capacitance. The loss of a swath oscillation indicates a blow-up is occurring.

DETAILED DESCRIPTION OF THE ILLUSTRATED EMBODIMENTS

The apparatus chosen for purpose of illustration is generally disclosed in U.S. Pat. No. 3,860,369, the entire disclosure of which is incorporated by reference.

Figure 1:
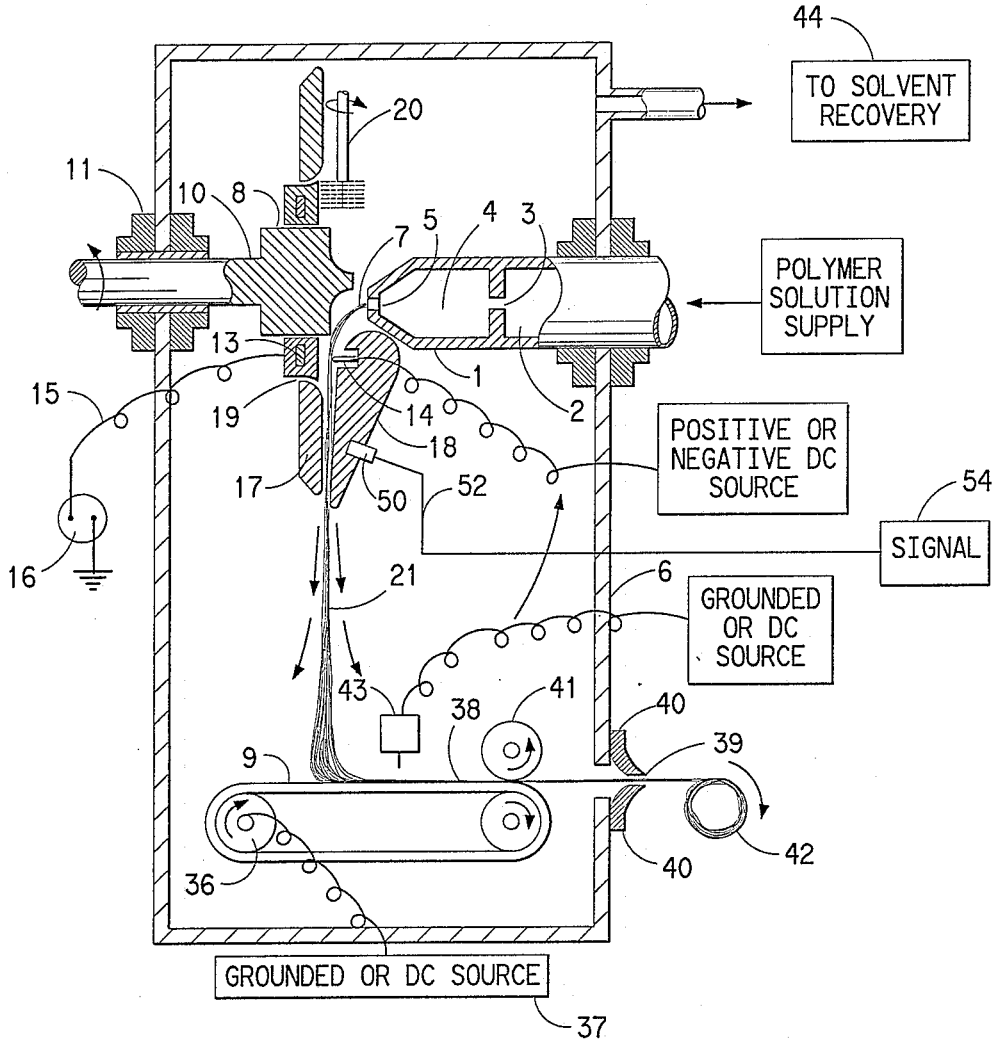
FIG. 1 is a cross-sectional elevation indicating schematically the arrangement of various elements of an apparatus which can be used in the practice of the invention.

Referring to FIG. 1, a spinneret device 1 is shown connected to a polymer solution supply source. Polymer solution 2 under pressure is fed through an orifice 3 into intermediate pressure or letdown pressure zone 4 and then through spinning orifice 5 into web forming chamber 6. The extrudate from spinning orifice 5 is a plexifilamentary strand 7. Due to the pressure drop at spinning orifice 5 and the high temperature of the spinning solution, vaporization of solvent creates a vapor blast which, by passage along the surface of baffle 8 concomitantly with plexifilament 7, generally follows the path of advance from spinning orifice 5 to collecting surface 9, thereby creating a flow pattern within chamber 6 as indicated by the arrows in FIG. 1. Baffle 8 is mounted on shaft 10 which is mounted in bearing 11 and is rotated by means not shown. The surface of baffle 8 is so contoured that the plexifilamentary strand 7 issuing from orifice 5 is deflected into a generally vertical plane and simultaneously spread laterally to form a plexifilamentary web 21 which oscillates from side-to-side as baffle 8 is rotated.

The plexifilamentary web 21 passes from baffle 8 directly into the aerodynamic shield of this invention. The shield is comprised of front member 18 and a rear member comprising elements 13 and 17. Multineedle ion gun 14 is mounted on the interior surface of front member 18, and is connected to constant current power supply. A corona discharge occurs between needles 14 and target plate 13 which is disposed so that the vapor blast originating at 5 and deflected by baffle 8 carries the plexifilament web along its charging surface. Target plate 13 is connected via commutating ring and brushes to ground by wire 15 and microammeter 16 which indicates target plate current.

Target plate 13 together with concentric annular segment 17 comprise the rear member of the aerodynamic shield. Target plate 13 is adapted to be rotated concentrically with, but independent of, baffle 8 by means not shown. During rotation of the rear member, its interior surface passes by rotating brush 20, driven by means not shown, so that the surface of target plate 13 and adjacent parts may be cleared of any debris, thereby furnishing a continuously cleaned surface for optimum operation of the corona discharge. At intervals, in a circular pattern, the rear shield member is pierced by ports 19 through which ambient gas may be aspirated into the step region between concentric disc segments 13 and 17.

Figure 3:
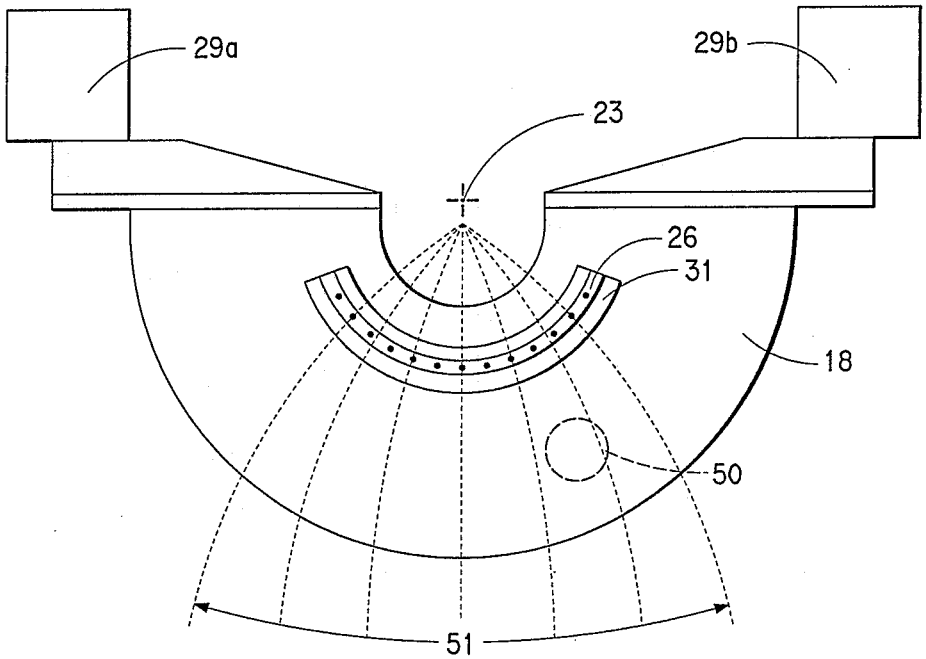
FIG. 3 is a view of the web facing surface of the front shield member of FIG. 2.

After exiting the aerodynamic shield, plexifilament web 21 is deposited upon a collecting surface 9. The surface illustrated is a continuous electrically conductive belt forwarded by drive roll 36. The belt may either be grounded or charged to a positive or negative potential by power source 37. Due to differences in their electrostatic charge, the plexifilament web 21 is attracted to surface 9 and clings to it in its arranged conditions as a swath 38 with sufficient force to overcome the disruptive influences of whatever vapor blast may reach this area. Since high rates of production can generate high turbulence in chamber 6, auxiliary corona devices 43 stationed just above the surface of belt 9 may be employed to place even higher electrostatic charge on swath 38, thereby pinning it even more tightly to belt 9. Wide sheets are produced by blending and overlapping the output from several spinning positions placed in an appropriate manner across the width of a receiving surface such as the belt 9. The sheet is then lightly compacted by roll 41 and is collected on windup roll 42 after passing through port 39 and flexible elements (or rolls) 40 which assist in retention of vapor within chamber 6. A conventional solvent recovery unit 44 may be beneficially employed to improve economic operation. A detector 50 is mounted in a fixed position in front member 18 at a position within the oscillating path 51 of the web (FIG. 3). Detector 50 is connected to a signaling means 54 via a cable connected to the output terminal of the detector.

Figure 2:
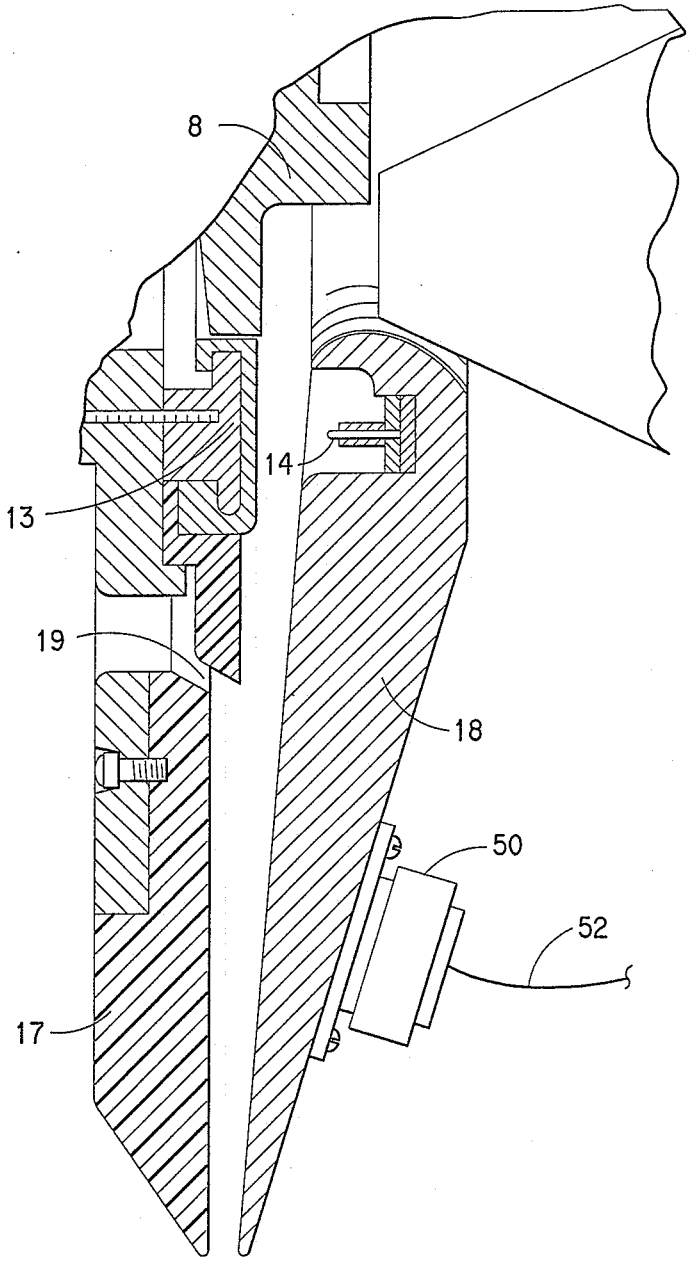
FIG. 2 is a more detailed cross-sectional view of a portion of a preferred embodiment of the aerodynamic shield of the present invention.

FIG. 2 is an enlarged cross-sectional view of a portion of the aerodynamic shield depicted in FIG. 1. The detector 50 is clearly shown recessed in front member 18 in a fixed location while in FIG. 3, which is a view of the web facing surface of front member 18, the detector 50 is shown located with the path 51 of the oscillation of the web.

Figure 4A:
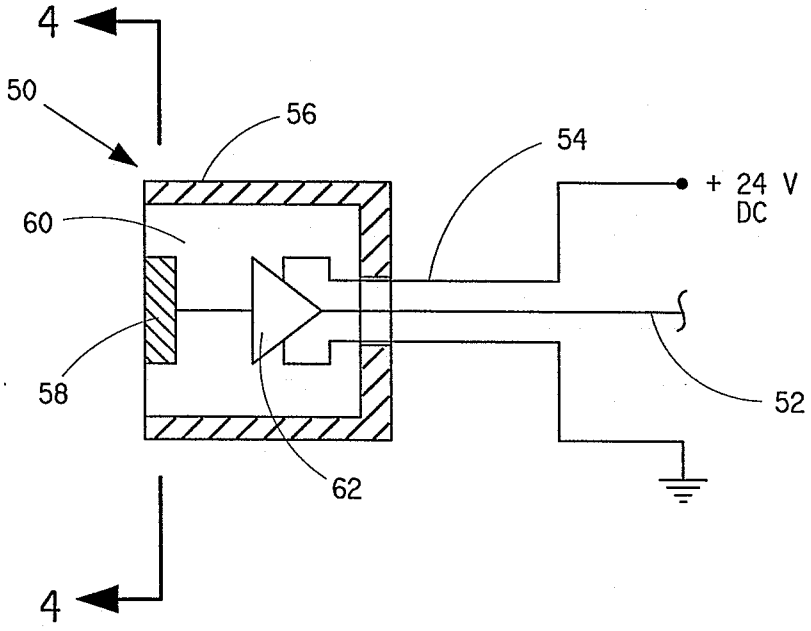
FIGS. 4 and 4*a* are a schematic cross-sectional illustration of front and side elevation views of the charge detector of this invention.
Figure 4:
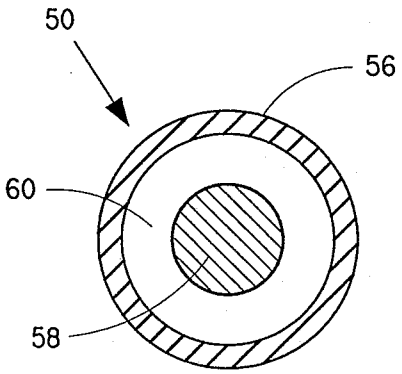

Referring now to FIGS. 4 and 4*a*, the detector 50 is shown and includes a housing 56, an electrically conductive plate 58, directly connected to a preamplifier 62, both located and encased in an electrically insulating material 60 within housing 56. Preamplifier 62 is energized from a 24 volt DC source via line 54 and the detector output lead or terminal 52 is connected to preamplifier 62.

In operation, the charged oscillating web induces an electrostatic charge on plate 58 that builds up and collapses according to the frequency of oscillation of the web. This produces an AC voltage on the plate 58 proportional to the charge in front of the plate, i.e. the frequency of oscillation of the web. The signal is amplified in preamplifier 62 to provide a signal output on terminal line 52 which in turn is connected to logic module 59 which has a light emitting diode that signals the absence of a signal from the detector, thus alerting the machine operator to shut down the position to prevent a blow-up.

We claim:

1. In an apparatus for forming a fibrous web that includes means for flash spinning a polymer solution to form a plexifilamentary strand, means for spreading the strand to form a web and oscillating the web at a frequency in a path in a generally vertical plane toward a collecting surface, means for charging said web and an aerodynamic shield having front and rear members disposed on each side of said plane, a device for detecting the loss of oscillation of the web comprising: a detector fixed to said shield and located within the oscillating path of the web, said charge detector having an output terminal connected to a signaling means, said charge detector providing a signal at its output terminal proportional to the oscillating frequency of the oscillating web, said signal means signaling the absence of said signal to indicate loss of oscillation of said web.

2. The device of claim 1 including a preamplifier connected between said detector and said output terminal in close proximity to said detector, said detector and said preamplifier being encased in a housing, said housing being mounted in a recess of said front member.

* * * * *